US010822727B2

(12) United States Patent
Soylu

(10) Patent No.: US 10,822,727 B2
(45) Date of Patent: Nov. 3, 2020

(54) PRODUCTION OF PAPER YARN FROM CELLULOSE-CONTAINING PLANT SPECIES

(71) Applicant: VERITAS TEKSTIL KONFEKSIYON PAZARLAMA SANAYI VE TICARET ANONIM SIRKETI, Denizli (TR)

(72) Inventor: Mustafa Soylu, Denizli (TR)

( * ) Notice: Subject to any disclaimer, the term of this patent is extended or adjusted under 35 U.S.C. 154(b) by 214 days.

(21) Appl. No.: 16/068,238

(22) PCT Filed: Jul. 12, 2016

(86) PCT No.: PCT/TR2016/050223
§ 371 (c)(1),
(2) Date: Jul. 5, 2018

(87) PCT Pub. No.: WO2017/119857
PCT Pub. Date: Jul. 13, 2017

(65) Prior Publication Data

US 2019/0010633 A1 Jan. 10, 2019

(30) Foreign Application Priority Data

Jan. 6, 2016 (TR) ..... 2016/00185

(51) Int. Cl.
*D02G 3/08* (2006.01)
*D01B 1/50* (2006.01)
(Continued)

(52) U.S. Cl.
CPC ..... *D02G 3/08* (2013.01); *D01B 1/16* (2013.01); *D01B 1/22* (2013.01); *D01B 1/50* (2013.01); *D01C 1/02* (2013.01); *D01H 1/22* (2013.01)

(58) Field of Classification Search
CPC ... D02G 3/08; D01B 1/16; D01B 1/22; D01B 1/50; D01C 1/02
See application file for complete search history.

(56) References Cited

U.S. PATENT DOCUMENTS 1,889,377 A * 11/1932 Rossati ..... D01C 1/02 162/9
1,913,202 A * 6/1933 Hayes-Gratze ..... D01C 1/02 162/20
2,045,498 A * 6/1936 Stevenson ..... D02G 3/08 493/328
(Continued)

FOREIGN PATENT DOCUMENTS

GB 763716 A 12/1956
GB 2282828 A * 4/1995 ..... B01D 39/04
IN 211713 B 11/2007

OTHER PUBLICATIONS

R.W. Kessler et al, "Steam explosion of flax—a superior technique for upgrading fibre value", Biomass and Bioenergy,vol. 14, No. 3, Aug. 8, 1994 (Aug. 8, 1994), p. 237-249, XP055328814.
(Continued)

*Primary Examiner* — Shaun R Hurley
(74) *Attorney, Agent, or Firm* — Egbert Law Offices, PLLC

(57) ABSTRACT

The method disclosed relates to the production of paper yarn from cellulose-containing plant species, in the textile sector, and particularly relates to obtaining a paper yarn by a wet spinning method using high or low purity cellulose raw material isolated from the wild plant species of *Calluna Vulgaris.*

10 Claims, 2 Drawing Sheets

Figure 1:
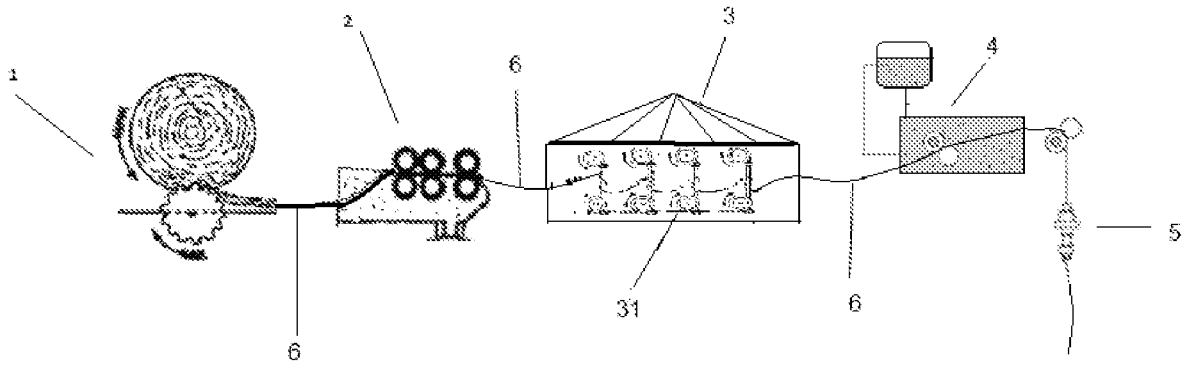

(51) Int. Cl.

| | |
|---|---|
| ***D01C 1/02*** | (2006.01) |
| ***D01B 1/16*** | (2006.01) |
| ***D01B 1/22*** | (2006.01) |
| ***D01H 1/22*** | (2006.01) |

(56) References Cited

U.S. PATENT DOCUMENTS 2,072,138 A * 3/1937 Sherman ..... D02G 3/08 162/196
2,332,020 A * 10/1943 Simpson ..... D02G 3/08 383/92
2,741,894 A * 4/1956 Schulze ..... D01B 9/00 57/295
2014/0331893 A1* 11/2014 Salmela ..... D02G 3/02 106/162.1
2015/0292121 A1* 10/2015 Salmela ..... D21F 9/003 57/401
2016/0122947 A1* 5/2016 Kajanto ..... D21H 21/02 162/146
2016/0355981 A1* 12/2016 Chtourou ..... B31D 1/0056
2017/0226662 A1* 8/2017 Yoshida ..... D06M 11/38
2018/0094081 A1* 4/2018 Nuopponen ..... A61K 31/717
2019/0024307 A1* 1/2019 Soylu ..... D21C 1/10
2019/0335935 A1* 11/2019 Bushman ..... A47J 31/06

OTHER PUBLICATIONS

Zhanwu Sheng et al, "Effect of steam explosion on degumming efficiency and physicochemical characteristics of banana fiber", Journal of Applied Polymer Science,vol. 131, No. 16, Mar. 6, 2014 (Mar. 6, 2014), p. n/a-n/a, XP055119116.

* cited by examiner

PRODUCTION OF PAPER YARN FROM CELLULOSE-CONTAINING PLANT SPECIES

THE RELATED ART

The invention relates to production of paper yarn from cellulose-containing plant species, in textile sector. The invention particularly relates to obtaining paper yarn by wet spinning method using high or low purity cellulose raw material isolated from the wild plant species of *Calluna Vulgaris*.

THE PRIOR ART

Nowadays, studies on flax and many other stem fibres have increased. This is because, flax is also a raw material for oils and composites as well as textile products. In addition, technical textiles and some special textile products are advantageous both for their high added value and for increasing competitiveness of producers. Flax and other stem fibres can be used easily in such products. Apart from that, they do not cause any environmental problem, since they are natural. However, they need to be cleaned and put through a great deal of processes before they can be used. Since flax is a stem fiber, it is generally obtained from the outer side of the stem, between the bark and internal tissue, and becomes usable following a retting process. Retting is biochemical separation of fibers from non-fiber tissues. Disadvantages of other retting methods are eliminated by means of enzymatic retting and dew retting methods. Modified, high quality, and reproducible fibers can be obtained for specific applications.

Bast fibers such as jute, ramie, hemp, kenaf, and flax can be obtained from cortical zones of plant stems. Flax (*Linum usitatissimum* L) is the oldest known stem fiber as well as being an agricultural product used as food and fuel.

Flax fibers also contain specific sugars aside from having high level of cellulose. Pectinasic and hemicellulosic sugars are eliminated during retting. When a retted flax sample is utilized, the amounts of glucose, mannose, and galactose are reduced by 50%, 27%, and 8% respectively in the remaining part. The galactan chains and arabinogalactan proteins found on the secondary wall give flax a significant strength. While carbohydrates are predominant on the stem tissue, there are also aromatic substances, waxes, and cutine in small quantities.

In Table 1 given below, the content of flax and hemp fibers are provided.

TABLE 1

Flax and hemp fiber contents

| Genus of Plant | Cellulose % | Hemi-Cellulose % | Pectin % | Lignin % | Wax % |
|---|---|---|---|---|---|
| Flax | 65.0-75.0 | 12.0-15.0 | 1.4-5.7 | 2.5-5.0 | 1.2-1.8 |
| Hemp | 51.0-63.0 | 16.0-18.0 | 3.8-6.8 | 6.3-9.3 | 1.0-1.8 |

The purpose of retting process is to enable cellulose fibers to be released by separating them from the surrounding tissues. It is achieved by either penetration of micro organisms into the plant stem or transforming the pectinase binding fiber bundle together into simple water soluble compounds through enzymatic processes.

Retting can be made in dew, still water, running water, hot water, chemically or enzymatically. Water retting based on fermentation with anaerobic bacteria provides high fiber quality; nonetheless, it causes unacceptable environmental wastes. Therefore, application of this process was abandoned years ago. Dew retting is made by keeping fibers in outdoor area with aerobic fungi. This method is preferred, and many flax fibers are produced in this manner. However, dew retting has disadvantages such as;

- dependence on certain geographical regions having suitable humidity and temperature for retting,
- coarser and lower quality fiber yield compared to water retting,
- decrease in consistency of fiber properties,
- keeping agricultural lands occupied for weeks.

Thus, retting process is still a big problem for flax fiber production. In 1980's, various studies came to be made in order to improve enzymatic retting to replace dew retting.

As a result of these studies, Flaxzyme, a commercial enzyme mixture, and various enzymes were produced by Nova Nordisk (Denmark). Sharma used enzyme mixture to eliminate non-cellulosic sections of dew-retted fibers in 1987. In 1991, Van Sumere and Sharma found out that properties of the fibers obtained by means of retting by using Flaxzyme such as fineness, durability, colour and waxy structure are comparable to those of flax fibers retted in water in the best way. Dew retting is still used most despite all the developments.

Price is one of the most important reasons hindering development of enzymatic retting process commercially. Studies are made in order to redevelop flax fiber industry for its use in textile and composites, and enzymatic retting process is developed. Non-cellulosic materials must be eliminated to increase processing capability and performance of end products.

Flax fiber is processed in a kier boiling bath as follows.

In kier boiling process, 400 kg flax fiber is submerged in a suitable autoclave bath. It is kept at 120° C. under 3 atmosphere pressures for 6 hours with 50 kg sodium hydroxide, 100 kg sodium carbonate, and 20 kg wetting agent in a 4 $m^3$ bath. Afterwards, the bath is filled with fresh water and boiled under 2 atmosphere pressure for half an hour. Then, the fibers are washed with water jet under 4-5 atmosphere pressure. Bleaching process is applied following kier boiling process. In the bleaching process, the fibers are treated with a 2% sodium hypochlorite solution between 8-10 Bome. They are neutralized with 2% sulphuric acid at 66 Bome for 20 minutes. Said boiling process is a process step applied after the roving (obtaining cord) process.

In order to obtain flax fibers, first of all, the stems of the plants are separated during the harvest season. Afterwards, retting, scutching, hackling, stripping, roving, boiling and wet spinning processes are applied respectively on the remaining stem parts.

One of the methods used for flax yarn production is wet spinning method. The characteristic feature of a wet spinning machine is being formed of a single pair of feed rollers and two pairs of spinning rollers. Wet spinning is made by moving the spindle up and down while the platinum ring found in the spinning system is in a fixed state.

The yarns obtained from flax and hemp has hard touch and low hydrophility. Desired flexibility and bulkiness cannot be obtained by using these yarns in manufactured textile products and particularly in home textile, towel, bathrobe, doormat, and quilt cover sets. Flax and hemp yarns have a hard structure because of the retting process at the production phase. The machines used in weaving operation stop frequently due to breaking of these yarns. In the bleaching process as one of the treatment processes in dye houses, 10 times more caustic is required to be used compared to cotton in order to achieve the desired whiteness. In consequence of such bleaching process, resistance of the manufactured product decreases and its economic life is shortened.

The paper yarn OJO+ known in the prior art is obtained from environment friendly and renewable natural filament fibres. Its raw material is Manila Hemp/Abaca plant. Species of the said plant is *Musaceae Musa*, and its class is natural cellulose fiber.

Manila Hemp/Abaca plant ripens in 3 years and reach 5-6 mm length and 20-40 cm width. Its fibers are 3.5 mm long and 16-35 μm wide. Surface of the fibers are covered with lignin and cell walls.

Manila Hemp is a member of banana tree family. Previously, it was called Hemp yarn and rope. This plant is grown in South and Central America besides originating from Philippines, Sumatra, and Borneo.

Manile Hemp plant lives up to 10 years by itself, and it is harvested between 3-8 months following the first 18-26 months of growth. The fibers obtained from these plants are resistant to salt water, so they are generally used in hawses and nets in ships. Other areas of use are coarse-grained papers, folders, and rugs.

Manile Hemp plant fibers look hard and have smooth walls. Its walls look cross-striped. Its parenchyma cells may be in rectangular or round shape. Sometimes, spiral thickening is present.

OJO+ paper yarn is only slightly wooly. The fact that this yarn is slightly wooly facilitates ventilation while wearing. In addition, it has stronger heat insulation property than flax in summer and winter. It is a type of yarn that is fast-growing, 100% organic, environment friendly, biodegradable; does not emit toxic gas when burnt and cause carbon dioxide emission and waste in soil.

In OJO+ paper production, stems of Manila Hemp plant is separated from its roots at first; then, crusts on the leaves are striped and fiber bundles are obtained. The fiber bundles are boiled in the boiler by adding water and necessary chemicals. It is spun by steaming. It is stirred at high temperature for a couple of hours. Paper is made out of the pulp obtained. The paper roll is passed through specially-designed machinery, and 30-25 g/m$^2$ wood pulp layer is prepared and cut in various dimensions depending on the desired number of yarns. For example, 1 mm-4 mm wide strips can be obtained. Then, weaving and darning yarns are obtained by spinning the strips.

It is hard to spin the yarn due to production process of Ojo paper yarn. This yarn is as hard as flax and hemp. It cannot be spun with yarns such as Polyester, Polyvinyl alcohol cotton, and Polyamide. Manufactured products with high hydrophility and soft touch cannot be made of it, because it cannot be spun especially with polyvinyl alcohol, that is PVA yarn. In addition, yarn breakage occurs in sizing and spinning processes of ojo paper yarn. Likewise, weaving machine cannot work efficiently due to yarn breakages.

In the present art, special climate conditions are required for plants such as bamboo plant, cotton, flax, and hemp. It is very important to use agricultural lands allocated for cellulose resources in the world efficiently. Aside from natural resources, it is aimed to produce cellulose through mutation or modification of genetic structures of plant species in order to increase and develop the resources of cellulose. For example, cellulose is obtained from strawberry plant by modifying its genetic structure. These processes require use of chemical fertilizer or agricultural pesticide.

In the prior art, below given disadvantages are encountered:

- products have low hydrophility
- products have hard touch
- efficient work cannot be done with hard yarns in weaving machines
- alternative cellulose sources cannot be found.

As a result, the above said drawbacks and the inadequacy of the prior art solutions about the subject have necessitated an improvement in the related technical field.

BRIEF DESCRIPTION OF THE INVENTION

The invention relates to production of paper yarn from cellulose-containing plants, which meets the above said requirements, eliminates all of the drawbacks, and brings some additional advantages.

The primary purpose of the invention is to obtain more flexible and softer yarn than artificial yarns such as flax and hemp.

A purpose of the invention is to obtain yarns from *Calluna Vulgaris* (L.) Hull and Ericaceae plant species, which originates from the same family with *Calluna Vulgaris* (L.) Hull.

A purpose of the invention is to obtain flax, hemp etc. yarns having hard touch with the desired flexibility and bulkiness in manufactured textile products and especially in home textile, towel, bathrobe, doormat, and quilt cover sets.

Another purpose of the invention is to obtain yarn from plants that do not require special climate conditions, and use of chemical fertilizers and agricultural pesticides that are required for bamboo, cotton, flax, and hemp etc. plants.

Another purpose of the invention is to develop an alternative paper yarn production method with lower cost than known production methods.

Another purpose of the invention is to obtain artificial yarn that is easy to use in knitting or weaving processes.

Another purpose of the invention is to reduce the time period during which the machine does not work (stops) during weaving operation due to breaking of yarns.

In order to achieve the above said purposes, the invention is a method of obtaining paper yarn from cellulose-containing plants, comprising the operation steps of:

- obtaining cord or pulp strips from a cellulose-containing plant,
- passing the obtained cord or pulp strips through a caustic bath,
- providing saturated steam in steaming section,
- adjusting the pH value in a neutralization bath, and
- performing spinning.

In order to achieve the above said purposes, said cellulose-containing plant, preferably consists of Ericaceae plant species or *Calluna Vulgaris* plant.

In order to achieve the above said purposes, the step of obtaining pulp strips comprises the operation steps of:

- treating the fiber bundles obtained from a cellulose-containing plant under pressure and in a solution containing the chemical substances of NaOH, $Na_2BO_3$, $H_2O_2$ and $MgSO_4$,
- washing,
- dividing into strips.

In order to achieve the above said purposes, the cord obtaining (roving) step comprises the operation step of:

- retting, scutching, hackling, stripping, and roving applied on the stem of cellulose-containing plants, respectively.

In order to achieve the above said purposes, the cords or pulp strips are passed through a sodium hydroxide solution in the caustic bath. The strips/cords are preferably passed through a 20-30 g/lt of sodium hydroxide solution in a caustic bath of 40 C.°-90 C.° temperature.

In order to achieve the above said purposes, said caustic bath comprises:

carrying rollers, feed rollers, and spinning rollers positioned successively in order to apply spinning on the cord or pulp strips and provide orientation of the fibers forming the strips/cords, during passage of the cords or pulp strips through the caustic bath. Said carrying rollers, feed rollers, and spinning rollers are formed of double cylinder structures placed on top of each other.

In order to achieve the above said purposes, said spinning rollers comprise a distance adjuster for adjusting the distance thereof with the feed rollers. Said distance adjuster consists of an iron bar and a latch embodiment connected to the spinning rollers.

In order to achieve the above said purposes, the strips/cords are treated with saturated steam for 20-60 minutes in the steaming section. Grooved and/or hexagonally-structured transfer rods are found in the steaming section. Said transfer rods comprise independently operating drive components.

In order to achieve the above said purposes, the pH of the strips/cords are checked and their pH values are adjusted between 5-7 in the neutralization bath.

In order to achieve the above said purposes, the invention is paper yarn obtained from *Calluna Vulgaris* plant.

The structural and characteristic features of the invention and all of its advantages shall be understood better with the figures and the detailed description given below in reference to the figures. Therefore, the assessment should be made by taking into account the said figures and detailed explanations.

FIGURES FOR BETTER UNDERSTANDING OF THE INVENTION

FIG. 1: is the schematic view of the process in the method of the invention.

Figure 2:
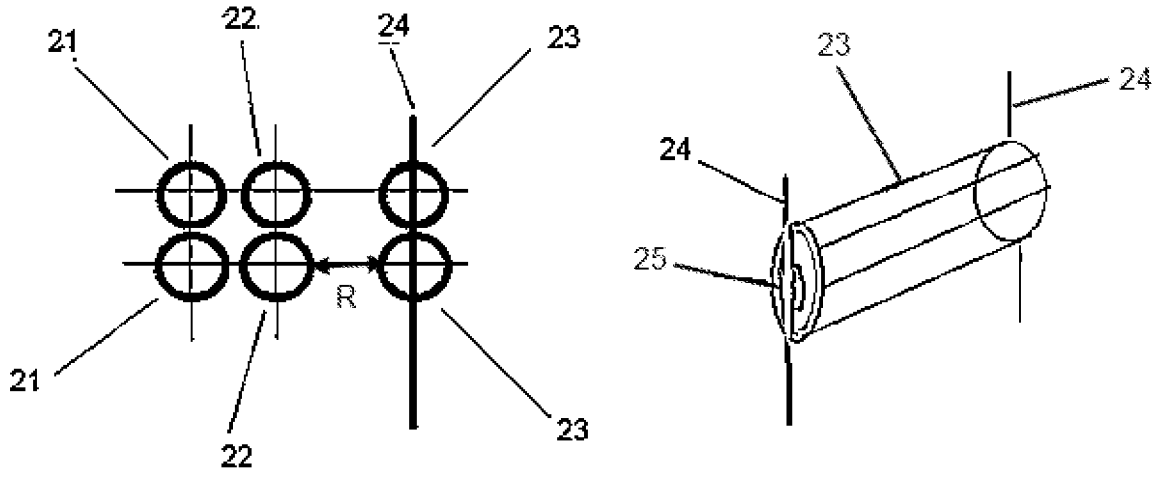

FIG. 2: is the detailed view of the distance adjuster, carrying, feed, and spinning rollers for caustic bath in the method of the invention.

Figure 3:
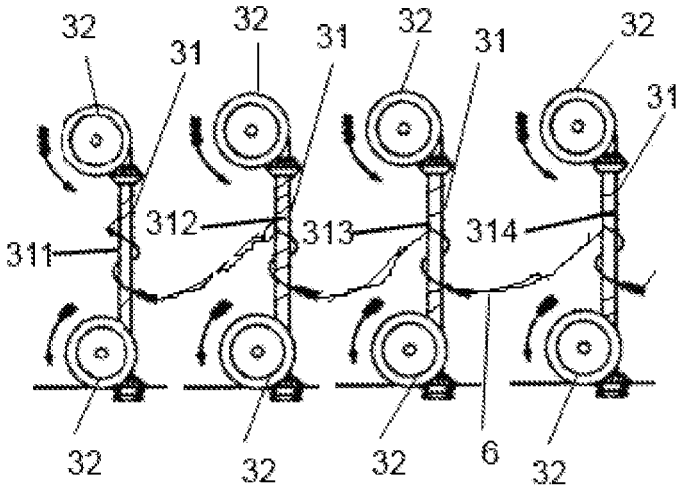

FIG. 3: is the detailed view of the steaming section transfer rods in the method of the invention.

Figure 4:
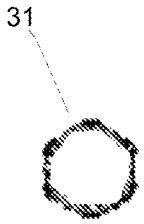

FIG. 4: is the longitudinal section view of the transfer rod.

Figure 5:
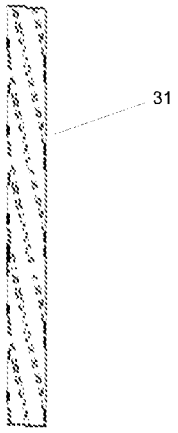

FIG. 5: Is the cross-section view of the transfer rod.

Figure 6:
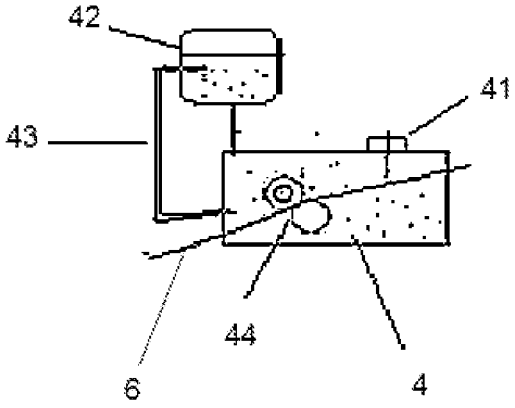

FIG. 6: is the detailed view of the neutralization bath in the method of the invention.

Drawings do not have to be scaled and details not necessary for understanding the present invention may be neglected. Moreover, components which are at least widely equal or which have at least widely equal functions are shown with the same number.

DESCRIPTION OF PARTS REFERENCES

1. Pulp roll
2. Caustic bath
  21. Carrying roller
  22. Feed roller
  23. Spinning roller
  24. Rod
  25. Latch
3. Steaming section
  31. Transfer rod
    311. First rod
    312. Second rod
    313. Third rod
    314. Fourth rod
  32. Drive component
4. Neutralization bath
  41. pH meter
  42. Additional acid tank
  43. Recycling line
  44. Transfer roller
5. Spinning machine
6. Strip/Cord
R: the distance between the feed rollers and the spinning rollers

DETAILED DESCRIPTION OF THE INVENTION

In this detailed description, production of paper yarn from cellulose-containing plant species according to the invention and the preferred embodiments thereof are only disclosed for better understanding of the subject without forming any limiting effect.

The invention relates to production of paper yarn from cellulose-containing plant species and paper yarns obtained with this method. The invention preferably relates to paper yarn obtained from *Calluna Vulgaris* (L.) Hull and Ericaceae plant species originating from the same family, and to the method of production thereof.

Below, the characteristics of *Calluna Vulgaris* plant are given.

Biological class: Plant
Branches on the family tree: Angiosperms, Eudicots, Asterids
Regnum: Ericales
Family: Ericaceae
Genus: *Calluna Salisb*
Species: *Calluna Vulgaris*
Latin name: *Calluna Vulgaris* (L.) Hull

*Calluna Vulgaris* is a wild dwarf plant growing in acidic soil in pasture areas in cold winter months. It is a plant species that may threaten biological diversity in plateaus. It is typically a 0.5-1.25 meter high, evergreen, woody, and scrubby plant. It is pretty wooly in the beginning of growth. Then it becomes bare. It has stalkless leaves that extend through the branches; grow in four vertical lines; are green in the beginning and then become brown; and have wools up to 3.5 mm long. While its bell-shaped flowers are pale blue, they may also be pink and white. The flowers grow on the narrow leaves. Its tiny seeds are 0.5 mm long and 0.7 mm wide and in the shape of four-cell round capsules. *Calluna Vulgaris* spreads easily and it may occupy new areas rapidly.

*Calluna Vulgaris* grows new leaves and shoots beginning from spring to autumn. Its flowers are necklace-shaped and stand suspended downwards, and come into blossom towards the end of autumn. It buds out towards the end of winter. Its seeds germinate all year round. But the best germination occurs during spring and autumn. After a forest fire, it becomes capable of producing seeds in 3 years in that region. Dense green offshoots of *Calluna Vulgaris* plant become woody and may live about 30 years. Each plant is capable of giving one million seeds per square meter by producing 3000-4000 flowers and thousands of seeds. Its weak and tiny looking seeds survive for about 100 years. They are spread by wind or contact with animals. The seeds can even germinate only through thermal treatment without getting any light. It can also make vegetative reproduction. *Calluna Vulgaris* comes out in steppes, inside forest lands, and throughout tree lines. They are colonized up to 1500 meters height. They are capable of growing in wet and marsh areas; it is extremely resistant to icing.

Other species covered are named in Latin as Erica Cinera, Erica Lusitanica, and Erica Manipuliflora Salisb. They are found in Giresun, Trabzon, Rize, Artvin, and Istanbul in Turkey.

The fact that this plant is capable of growing in acidic soils and winter months; each plant is capable of giving one million seeds per square meter by producing 3000-4000 flowers and thousands of seeds; and it can grow in marsh areas are the most significant characteristics of the wild plant, *Calluna Vulgaris*.

Below, the contents of *Calluna Vulgaris* plant species are given.

TABLE 2

*Calluna Vulgaris* plant species contents

| Genus of Plant | Holocellulose (% Dry weight) | Hemi-cellulose (% Dry weight) | Alpha cellulose (% Dry weight) | Lignin (% Dry weight) |
|---|---|---|---|---|
| *Calluna Vulgaris* | 36.6 | 15.2 | 21.4 | 26.8 |

Since *Calluna Vulgaris* plant contains 21.4% cellulosic raw material, it is considered as a natural cellulose source.

The method of obtaining paper yarn from cellulose-containing plants according to the invention, generally comprises the operation steps of:

obtaining cord or pulp strips (6) from a cellulose-containing plant, passing the obtained cord or pulp strips (6) through a caustic bath (2), providing saturated steam in steaming section (3), adjusting the pH value in a neutralization bath (4), and performing spinning.

In the Step of Obtaining Cord and Pulp Strips (6) from a Cellulose-Containing Plant;

After the stems of *Calluna Vulgaris* plant is separated from its roots; then, crusts on the leaves are stripped and fiber bundles are obtained. Fiber bundles are added into a boiler together with water and required chemicals (NaOH, $Na_2BO_3$, $H_2O_2$, $MgSO_4$) and boiled and stirred with introduction of steam. Pulp is obtained by treating fiber bundles in the solution for 60 minutes at 160 degrees and under 8 kg/cm2 oxygen pressure.

In the process of obtaining cellulose pulp from *Calluna Vulgaris* plant, the chemicals NaOH, $Na_2BO_3$, $H_2O_2$, and $MgSO_4$ are used. *Calluna Vulgaris* bundles are reacted with NaOH (sodium hydroxide) solution for 60 minutes, at 160 C.°, and under 8 kg/cm2 oxygen pressure. Sodium perborate ($Na_2BO_3$) and hydrogen peroxide ($H_2O_2$) are added into the same solution in order to accelerate the reaction and obtain appropriate viscosity. $HO_2^-$, $B(OH)_3$, and $B(OH)_4^-$ molecules and active anion groups obtained as a result of the $Na_2BO_3$ and $H_2O_2$ reaction, form the cellulose pulp by being reacted with the cellulose fibers forming the *Calluna Vulgaris* bundles. The lignin structure formed of ether, phenol, and benzene rings with high macromolecular structure forming the cell walls of the plant together with cellulose, is removed from the cellulose macromolecules as a result of oxidative reaction. $MgSO_4$ is reacted with water within the solution and form $Mg(OH)_2$ compounds. Delignification is obtained with the oxidative effect of $Mg(OH)_2$ compound. Washing operations are made in high quantities.

The pulp is turned into a paper layer, and then this layer is divided into thin strips. The paper pulp layer obtained from the *Calluna Vulgaris* plant (25-30 g/m$^2$) is divided into 1-4 mm of pulp strips (6), and then turned into a pulp roll (1).

In the below given Table 3, the chemical substances used in obtaining cellulose pulp from *Calluna Vulgaris* plant and their ratios of use are provided.

TABLE 3

Chemical substances used in obtaining cellulose pulp from *Calluna Vulgaris* plant and their ratios of use

| Substances | Preferred amount by weight (%) | Usable amount by weight (%) |
|---|---|---|
| *Calluna Vulgaris* plant | 15 | 15 |
| NaOH | 12 | 12-20 |
| $Na_2BO_3$ | 5 | 5 |
| $MgSO_4$ | 6 | 6-10 |
| $H_2O_2$ | 6 | 6-10 |
| Water | 56 | 67-40 |

It is also possible to apply the method of the invention after obtaining cords (6) instead of pulp strips (6) from the cellulose-containing plants. During harvest season, after removing the scape parts of the plants, the operations of retting, scutching, hackling, stripping, roving, boiling and spinning are applied respectively on the remaining stem parts. Afterwards, the cords obtained from cellulose-containing plants are exposed to the same processes with the pulp strips such as passing through caustic bath, introducing saturated steam, adjusting the pH value, and wet spinning so as to obtain paper yarn.

In the Step of Passim the Obtained Cords and Pulp Strips (6) Through the Caustic Bath (2);

The cords or strip-form pulps (6) are passed through a 20-30 g/lt of sodium hydroxide (98 Bome) solution in a caustic impregnating bath of 40 C.°-90 C.° temperature. In the caustic bath (2); carrying rollers (21), feed rollers (22), and spinning rollers (23) are found for transfer of the strips (6), sodium hydroxide impregnation of the strips (6), and application of spinning, respectively. Moreover, a distance adjuster is found for adjusting the distance (R) between the feed rollers (22) and the spinning rollers (23). Said distance adjuster consists of an iron bar (24) and a latch (25). Sodium hydroxide solution is impregnated to the strips/cords (6) by means of carrying and feed rollers (21, 22). The feed rate of the feed and spinning rollers (22, 23) and the distance (R) between these rollers (22, 23) is adjusted so as to provide spinning and parallel orientation of the fibers forming the strips/cords (6). The feed rate of the feed and spinning rollers (22, 23) varies according to the basis weight of the paper pulp layer and the desired yarn count. If thicker yarns with yarn counts such as Ne10, Ne8 etc. are desired to be obtained, the rate of the feed rollers (23) are required to be 10-15% higher than the rate of the spinning rollers (23). On the other hand, if thinner yarns such as Ne30, Ne40 are wanted; strips (6) that are cut from a pulp layer of 20-25 g/m2 basis weight are used, while setting the rate/speed of the spinning rollers (23) 20-30% higher than the feed rollers (22). The distance (R) between the feed rollers (22) and the spinning rollers (23) is a significant factor in the parallel orientation of the fibers forming the strips (6), and as the distance (R) increases, the parallelism modification of the fibers forming the strips (6) also increases.

The strips/cords (6) advance within the caustic bath (2) by passing through carrying, feed, and spinning rollers (21, 22, 23). The carrying rollers (21) ensure transfer of the strips (6) to the feed rollers (22). The feed rollers (22) allow spinning operation by means of adjusting the transfer speed of the fibers forming the strips (6), and thus orient the cellulose fibers. The spinning rollers (23) adjust their distance (R) with the feed rollers (22) and by increasing the roller rate/speed, ensures orientation of the cellulose fibers during spinning of the cellulose strips (6) treated with NaOH in the caustic bath (2). Both of the feed and spinning rollers (22, 23) have active role in fiber orientation. The distance adjuster is connected to the spinning rollers (23). They ensure adjustment of the distance (R) between the feed rollers (22) and the spinning rollers (23). The distance (R) is adjusted by means of the iron bar (23) and the latch (25) forming the distance adjuster. The distance adjuster formed of the iron bar (24) and the latch (25) adjusts the distance (R) between the feed rollers (22) and the spinning rollers (23). In this way, smooth advancement of pulp strips (6) is ensured with the back-and-forth movement of the spinning rollers (23) while the pulp strips (6) coming from the carrying rollers (21) are being transferred from the feed rollers (22) to the spinning rollers (23). The distance adjuster formed of the iron bar (24) and the latch (25) is used in fixing the position of the spinning rollers (23). Moreover, orientation of the fibers forming the strips (6) is ensured by adjusting the distance (R). As the distance (R) increases, the parallelism modification of the fibers also increase. The distance adjuster formed of the iron bar (24) and the latch (25) is adjusted manually.

In the Step of Providing Saturated Steam in Steaming Section (3);

The strips (6) treated within the caustic bath (2) come to the steaming section (3). The strips (6) reaching the steaming section (3) are treated with saturated steam for 20 minutes at 100 degrees within the steaming tank. In the steaming section (3); transfer rods (31) are arranged successively within the steam tank having saturated steam pressure. There are 4 of said transfer rods (31), which are 90-100 cm in length, 12-16 cm in diameter, and have a grooved and hexagonal structure. Since the rods (31) have a grooved structure with 90-100 cm length, they ensure advancement of the strips (6) within the steaming section (3) for 20 minutes. Since the rods (31) have diameters between 12-16 cm and a hexagonal structure, the fibers can be retained on the rods (31) and therefore orientation of the fibers is ensured. Said rods (31) are moved by impeller embodiments in the form of rotating wheels connected to both ends of the rods (31). Said impellers are formed of drive components (32) allowing movement of the rods (31). An independently operating drive component (32) is found for each rod (31). In other words, movement of the rods (31) is ensured by individual drive components (32).

The fiber strips (6) proceed to the steaming section (3) by means of the transfer rods (31) positioned inside the steaming tank having saturated vapour pressure. Advancement of the fiber on the rods (31) is ensured by means of impellers (32) having individual driving engines. By adjusting the speed of these impellers (32), orientation of the fibers and treatment of the fiber strips (6) with saturated steam for 20 minutes are ensured. The grooves found on the rods (31) facilitate advancement of fiber strips (6) within the steam tank.

Advancement of the strips (6) that are formed of cellulose fibers treated with NaOH within the steaming tank under saturated steam pressure, ensures increasing of the fiber section by means of strengthening the hydroxyl bonds among the cellulose macromolecules.

In continuous systems, for efficient operation of the process line, the rod (31) size, diameter, and presence of the grooved structure contribute to the efficiency of the system. In modifying the fibers forming the strips (6), the temperature, humidity, the amount of time the strips (6) stay in the process, and the amount of time period they are treated with the chemical substance (NaOH) are of importance. Therefore, grooved rods (31) are required to be present in continuous systems for optimization of this time period. Here, the strips (6) advancing in the continuous system are allowed to be treated with the chemical substance NaOH within a caustic bath (2) as shown in FIG. 2. This operation can also be made by wrapping each one of these strips (6) around a bobbin and then treating with NaOH at 90 degrees in a tank (in bobbin dying machines), and then sending to wet spinning after neutralization. However, such a system is not efficient for production. Moreover, with this alternative system, it is not possible to provide orientation of the fibers.

In the method of the invention, at the section (3) where said steaming is made, use of grooved rods (31) increases efficiency. For each one of these grooved rods (31), an individual drive engine (32) is present for driving the rods (31). By means of the grooved rods (31), the strips (6) do not slide over the rod (31) and the strips (6) are enabled to be wrapped around the rod (31). Since each one of the rods (31) have their individual drive engines (32), the strips (6) can proceed in desired tightness. Initially, if the speed of the first rod (311) is denoted as 1D revolution/min, then the speed of the second rod (312) is denoted as 2D revolution/min, the third rod (313) as 3D revolution/min, and the fourth rod (314) as 4D revolution/min. The rod (31) sizes and rod (31) diameters are preferably designed such that the strips (6) would remain on the rods (31) for 12 minutes on the first rod (311), 6 minutes on the second rod (312), 3 minutes on the third rod (313), and would proceed 1 minute on the fourth rod (314) for the first 5000 metres. Steam saturation of the strips (6) treated with NaOH is only possible by keeping the steaming time period at the optimum level. In this way, the cellulose fibers forming the strips (6) would proceed within the system for the appropriate amount of time and thus gain hydrophilic characteristics. This appropriate amount of time is between 20 to 30 minutes. This time can also be between 20 to 60 minutes.

In the Step of Adjusting the pH Value in a Neutralization Bath (4);

The strips/cords (6) coming out of the steaming section (3) reach the neutralization bath (4). The neutralization bath (4) ensures adjustment of the pH value on the fiber. By means of the transfer rollers (44) found within said bath (4), the fiber is allowed to advance within the bath (4). The neutralization bath (4) comprises an additional acid tank (42) connected to a recycling line (43). It comprises an acidic solution with a pH value of 5-7. The pH measurement of the neutralization bath (4) is performed with a pH meter (41). According to the pH measurement outcome, circulation is performed between the neutralization bath (4) and the acid tank (42) through the recycling line (43).

In the neutralization bath (4), the pH value of the fiber strips (6) is adjusted between 5 to 7. In the neutralization bath (4), pH is checked and if the pH is not between 5 to 7, then acetic acid is added.

The adjustment of the pH value is made in order to prevent storage problems of the NaOH-treated strips (6) following spinning operation, and prevent the yarn from decomposing.

In the Step of Spinning;

The strips/cords (6) coming out of the neutralization bath (4) are turned into yarns by spinning in a wet spinning machine (5).

In the method of the invention, different from known methods, yarn is obtained by spinning the strips (6) passed through the caustic bath (2) in wet spinning machines (5). This yarn is more elastic and softer than the ones obtained with other methods. It provides easy of processing and increases efficiency in the subsequent knitting and weaving processes. It also provides permanent softness in the final product to be obtained.

In the market, flax and hemp fibers have a hard structure due to the retting operation during production stage, and cause the machine to stop frequently due to breaking in weaving operation. However, since the yarn obtained from the *Calluna Vulgaris* wild plant species according to the invention is not exposed to retting operation during production stage, it has a soft structure, and ensures operation of weaving machines without interruption. Since the fiber sections of the cellulose fibers increase in caustic bath, smoothness can be obtained in fiber orientation and intake of dyestuff is increased. Since the yarn wound easier, it is not like hard yarn such as flax and hemp. Thanks to its permanent softness, it can be used in end products such as towel, bathrobe etc.

The product made of the yarn obtained with the method of the invention has high hydrophility and soft touch. Since the fiber section increases, it has more air gaps and higher air circulation. Therefore, it dries faster than flax-hemp, ojo paper yarn, cotton yarn etc. yarns obtained from natural yarns. Since it can be wound/twisted easily, it is flexible and does not cause yarn rupture while advancing in a weaving machine, and performs efficiently.

By means of obtaining yarn from *Calluna Vulgaris* plant species, special climate conditions required for plants such as bamboo plant, cotton, flax, and hemp are not needed, since this plant is a wild plant grown in acidic soil, during cold winter months, and in wilderness. *Calluna Vulgaris* plant is a natural sustainable cellulose source. Sustainability is the most important criterion even for the cotton plant, which is also a natural cellulose source. Continuity is important in using cellulose sources. It is one of the important strategic steps to use agricultural lands allocated for cellulose resources in the world efficiently. In this sense, it is of great importance for the cellulose obtained from *Calluna Vulgaris* plant to be renewable, sustainable, and having efficient use in agricultural fields. Aside from natural resources, it is aimed to produce cellulose through mutation or modification of genetic structures of plant species in order to increase and develop the resources of cellulose. Since *Calluna Vulgaris* plant is a naturally grown plant, it does not require any chemical fertilizer or agricultural pesticide. Therefore, it is an environment friendly plant.

The invention claimed is:

1. A method of obtaining yarn from an Ericaceae plant species, the method comprising:
- obtaining cord or pulp strips from the Ericaceae plant species;
- passing the obtained cord or pulp strips through a caustic bath;
- providing saturated steam in a steaming section;
- passing the cord or pulp strips through the steaming section;
- adjusting a pH value in a neutralization bath;
- passing the cord or pulp strips through the neutralization bath; and
- spinning the cord or pulp strips after passing through the neutralization bath so as to obtain the yarn.

2. A method of obtaining yarn from an *Calluna Vulgaris* plant species, the method comprising:
- obtaining cord or pulp strips from the *Calluna Vulgaris* plant species;
- passing the obtained cord or pulp strips through a caustic bath;
- providing saturated steam in a steaming section;
- passing the cord or pulp strips through the steaming section;
- adjusting a pH value in a neutralization bath;
- passing the cord or pulp strips through the neutralization bath; and
- spinning the cord or pulp strips after passing through the neutralization bath so as to obtain the yarn.

3. The method of claim 2, wherein the step of obtaining cord or pulp strips comprising:
- treating fiber bundles obtained from the Calluna Vulgaris under pressure in a solution containing at least one of NaOH, $NaBO_3$, $H_2O_2$ and $MgSO_4$;
- washing the treated fiber bundles with water; and
- dividing the washed fiber bundles into the cord or pulp strips.

4. The method of claim 2, wherein the step of obtaining cord or pump strips comprising:
- retting, scutching, hackling, stripping and roving to a stem of the *Calluna Vulgaris*.

5. The method of claim 2, wherein the step of passing the cord or pulp strips through the caustic bath comprising:
- passing the obtained cord or pulp strips through a sodium hydroxide solution in the caustic bath.

6. The method of claim 2, wherein the step of passing the cord or pulp strips through the caustic bath comprising:
- positioning rollers, feed rollers and spinning rollers successively in the caustic bath;
- spinning and orienting the cord or pulp strips with the positioned rollers, feed rollers and spinning rollers in the caustic bath.

7. The method of claim 2, wherein the step of passing the cord or pulp strips through the steaming section comprises:
- treating the cord or pulp strips with the saturated steam for 20 to 60 minutes in the steaming section.

8. A method of obtaining yarn from a cellulose-containing plant, the method comprising:
- obtaining cord or pulp strips from the cellulose-containing plant;
- passing the obtained cord or pulp strips through a caustic bath;
- providing saturated steam in a steaming section, the steaming section having grooved or hexagonal transfer rods;
- passing the cord or pulp strips through the steaming section;
- adjusting a pH value in a neutralization bath;
- passing the cord or pulp strips through the neutralization bath; and
- spinning the cord or pulp strips after passing through the neutralization bath so as to obtain the yarn.

9. The method of claim 8, wherein the grooved or hexagonal transfer rods have independently operable drives.

10. The method of claim 8, further comprising:
- checking the pH value of the cord or pulp strips; and
- adjusting the pH value to 5-7 in the neutralization bath.

* * * * *